US008701892B2

(12) United States Patent
Gustafsson et al.

(10) Patent No.: US 8,701,892 B2
(45) Date of Patent: Apr. 22, 2014

(54) AMINE-CONTAINING FORMULATIONS FOR REVERSE FROTH FLOTATION OF SILICATES FROM IRON ORE

(75) Inventors: Jan Olof Gustafsson, Kungälv (SE); Malin Juberg, Svenshögen (SE)

(73) Assignee: Akzo Nobel Chemicals International B.V., Amersfoort (NL)

( * ) Notice: Subject to any disclaimer, the term of this patent is extended or adjusted under 35 U.S.C. 154(b) by 0 days.

(21) Appl. No.: 13/976,697

(22) PCT Filed: Dec. 23, 2011

(86) PCT No.: PCT/EP2011/073924

§ 371 (c)(1), (2), (4) Date: Jun. 27, 2013

(87) PCT Pub. No.: WO2012/089615

PCT Pub. Date: Jul. 5, 2012

(65) Prior Publication Data

US 2013/0277280 A1 Oct. 24, 2013

Related U.S. Application Data

(60) Provisional application No. 61/427,575, filed on Dec. 28, 2010.

(30) Foreign Application Priority Data

Dec. 28, 2010 (EP) ..... 10197173

(51) Int. Cl.
*B03D 1/01* (2006.01)
*B03D 1/016* (2006.01)
*B03D 1/02* (2006.01)

(52) U.S. Cl.
CPC *B03D 1/01* (2013.01); *B03D 1/016* (2013.01); *B03D 1/02* (2013.01)
USPC ..... 209/166; 252/61; 209/167

(58) Field of Classification Search
CPC ..... B03D 1/01; B03D 1/02; B03D 1/016
USPC ..... 209/166, 167; 252/61
See application file for complete search history.

(56) References Cited

U.S. PATENT DOCUMENTS

| | | | | |
|---|---|---|---|---|
| 2,483,890 | A * | 10/1949 | De Vaney | 209/166 |
| 3,363,758 | A * | 1/1968 | Cronberg et al. | 209/166 |
| 6,076,682 | A | 6/2000 | Gustafsson et al. | |

FOREIGN PATENT DOCUMENTS

| | | | |
|---|---|---|---|
| CA | 2205886 | | 12/1997 |
| EP | 2 017 009 | A1 | 1/2009 |
| SE | 421 177 | | 12/1981 |
| WO | WO 2004/080600 | A1 | 9/2004 |
| WO | WO 2008/077849 | A1 * | 7/2008 |

OTHER PUBLICATIONS

European Search Report for EP Application No. 10197173.7; Completion date Jun. 8, 2011.
International Search Report for PCT Application No. PCT/EP2011/073924; Completion date Mar. 26, 2012.
XP 025333812; Pearse et al "An Overview of the Use of Chemical Reagents in Mineral Processing," Minerals Engineering 18, pp. 139-149 (2005).
XP 025333798; Araujo AC et al "Reagents in Iron Ores Flotation," Minerals Engineering 18, pp. 219-224 (2005).
English Abstract of Swedish Publication No. SE 421 177 (1981).

* cited by examiner

*Primary Examiner* — Thomas M Lithgow
(74) *Attorney, Agent, or Firm* — Sugiarto Hadikusumo

(57) ABSTRACT

The present invention relates to a process for enriching an iron mineral from a silicate-containing iron ore by reverse froth flotation of the ore using a collecting composition comprising: a) a compound of formula $R^1O\text{-}A\text{-}NH(CH_2)_nNH_2$ (I), wherein $R^1$ is a straight or branched hydrocarbyl group with 12-15 carbon atoms, A is a group $—CH_2CHXCH_2—$, wherein X is hydrogen or a hydroxyl group, and n is a number 2-6; b) a compound of formula $R^2NH_2$ (II), where $R^2$ is a hydrocarbyl group having 12-14 carbon atoms; c) a compound of formula $R^3NH_2$ (III), wherein $R^3$ is a straight or branched, saturated or unsaturated hydrocarbyl group having 16-22 carbon atoms; and d) optionally a depressing agent for the iron mineral, wherein the amount of a) is at least 65% by weight, based on the total weight of a), b) and c), and at most 90% by weight, based on the total weight of a), b) and c), and wherein the weight ratio between c) and b) is 4:1 to 1:1.

22 Claims, No Drawings

AMINE-CONTAINING FORMULATIONS FOR REVERSE FROTH FLOTATION OF SILICATES FROM IRON ORE

This application is a National Stage entry of International Application PCT/EP2011/073924, filed Dec. 23, 2011, which claims the benefit of U.S. Patent Application No. 61/427,575, filed Dec. 28, 2010, and European Patent Application No. 10197173.7, filed Dec. 28, 2010. The contents of the aforementioned applications are incorporated herein by reference in their entireties.

FIELD OF THE INVENTION

The present invention relates to a reverse froth flotation process for removal of silicates from iron ore using specific formulations comprising a C12-C15 alkyl ether diamine, a C12-C14 alkylamine and a C16-C22 alkylamine.

BACKGROUND OF THE INVENTION

Iron ore often contains considerable amounts of silicates. The presence of silicates has a detrimental effect on the quality of the iron, and it is therefore essential that the silicate content of the iron mineral can be considerably reduced. A common process of removing silicates from iron ore is reversed froth flotation, where the silicates are enriched in the flotate and leave the system with the froth, and the iron ends up in the bottom fraction.

After a reverse froth flotation step, generally the iron ore bottom fraction either contains a low level of silica but exhibits a low recovery of iron, or it exhibits high recovery of iron but contains a high level of silica. Various solutions have been proposed in the prior art to increase iron recovery and at the same time reduce silica levels. Very often these solutions have involved grinding the ores to fine particles.

When the ore has to be very finely ground to reach enough liberation of the minerals a problem can occur with the froth structure in the flotation. Fine particles may have impact on both generation of froth volume and stabilisation of the froth. The latter very often give problems when handling the froth product, both in the process as well as in reclaiming the water in thickeners.

In many cases it is desired to improve the recovery of iron by further processing of the froth product. Especially when the separated particles in the froth contain a high degree of mixed grains, it is possible to recover more iron. Additional grinding of froth product to increase liberation of iron ore is used, and if magnetite ore is processed, then additional magnetic separation may be performed. These processes are hampered by high amounts of froth.

When recovering water by using tailing thickeners, it is desired to have clear water leaving the top surface of the thickener. If there is a lot of froth on the surface there will be a contamination of the purified water, and high amounts of tailing products will return to the process. That will have a negative effect on the overall process, for example it will give rise to froth formation in magnetic separators, classifiers etc and bring back contaminants into the process. Finally, it can be mentioned that high amounts of froth will create a bottle neck in the process, as it will limit the maximum feed of ore to be processed.

Grinding (also referred to as milling) is an important step of the flotation process, which step is necessary to liberate the valuable species in the ore. The particle size to which an ore must be size-reduced in order to liberate the mineral values from associated gangue or non-values is called the liberation size, and this will vary from ore to ore. Initial examination of the ore should be made to determine the degree of liberation in terms of particle size in order to estimate the required fineness of grind. Test work should then be carried out over a range of grinding sizes in conjunction with flotation tests in order to determine the optimum mesh of grind.

In order to describe the distribution of particle sizes in an ore, the $K_{80}$ value is generally used. The factor $K_{80}$ is defined as the sieve opening through which 80% by weight of the material of the mineral sample passes. For example, if an ore has a $K_{80}$ value of 75 μm, this means that 80% by weight of the material in the mineral sample will pass through a 75 μm sieve, and thus 20% by weight of the material of the sample will consist of particles having a diameter that is larger than 75 μm. The maximum $K_{80}$ value from a mineralogical point of view is determined by the milling needed to liberate the minerals. Thus, the less milling needed, the higher the value of $K_{80}$.

U.S. Pat. No. 6,076,682 discloses a process for enriching iron mineral from a silicate-containing iron ore by carrying out a reverse froth flotation in the presence of a silicate collecting agent containing a combination of at least one primary ether monoamine and at least one primary ether polyamine, where each of the ether amines contains an aliphatic hydrocarbyl group having 6-22 carbon atoms and the weight ratio of ether monoamine to ether polyamine is 1:4-4:1; and a depressing agent for the iron mineral. The working examples were performed with an iron ore having a $K_{80}$ of about 75 μm.

SE 421 177 discloses a way to enrich oxidic minerals, especially iron minerals, by separation of silicate-containing gangues by foam flotation using a collector that is a combination of C8-C24 alkyl, preferably C10-C16 alkyl, fatty amines (mono-, di- or polyamines) and C8-C24 alkyl, preferably C8-C14-alkyl, ether diamines. The weight ratio of ether diamine to fatty amine is defined to be larger than 1.1:1. The $K_{80}$ for the iron ore used in the working examples of this patent publication is 85 μm.

CA-A1-2 205 886 relates to compositions of matter comprising a blend of (a) an amine component, which is one or more compounds selected from the group consisting of alkyl amines, alkyl diamines, alkyl polyamines, ether amines and ether polyamines and mixtures thereof; and (b) a C3-C24 carboxylic acid or mixtures thereof; for use e.g. in the froth flotation of silica from iron ore. This patent publication is silent about the $K_{80}$-value of the mineral samples flotated.

WO 2008/077849 relates to a reverse froth flotation process for removal of silicates from iron ore having $K_{80} \geq 110$ μm using formulations comprising a C12-C15 alkyl ether diamine and a C12-C24 alkyl ether monoamine, a C12-C24 alkylamine or a C16-C24 alkyl diamine, wherein the weight ratio between the alkyl ether diamine and the other amine components is 1:5 to 5:1.

However, there still exists a need for collectors, with which reverse froth flotation of silicate-containing iron ore can be performed, that results in reduced froth formation and/or reduced froth stability.

SUMMARY OF THE INVENTION

One object of the present invention is to at least partly overcome the drawbacks of the prior art. It has surprisingly been found that low silica levels, high recovery of iron, reduced froth formation and reduced froth stability can be achieved for silicate-containing iron ores, including finely ground such ores, by performing a reverse froth flotation of the ore using a specific collecting composition comprising:

a) a compound of formula $R^1O\text{-}A\text{-}NH(CH_2)_nNH_2$ (I), wherein $R^1$ is a straight or branched hydrocarbyl group with 12-15 carbon atoms, A is a group —$CH_2CHXCH_2$—, wherein X is hydrogen or a hydroxyl group, preferably hydrogen, and n is a number 2-6, preferably 2-3, and most preferably 3;

b) a compound of formula $R^2NH_2$ (II), wherein $R^2$ is a hydrocarbyl group having 12-14 carbon atoms;

c) a compound of formula $R^3NH_2$ (III), wherein $R^3$ is a straight or branched, saturated or unsaturated hydrocarbyl group having 16-22, preferably 16-18 carbon atoms, and most preferably the group $R^3$ is oleyl; and d) optionally a depressing agent for the iron mineral, wherein the amount of a) is at least 65, preferably at least 70% by weight, based on the total weight of a), b) and c), and at most 90, preferably at most 85 and most preferably at most 80% by weight, based on the total weight of a), b) and c), and wherein the weight ratio between c) and b) is 4:1 to 1:1, preferably 3:1 to 1:1.

This collecting composition is capable of floating silica containing small particles with both remained efficiency and selectivity as well as with reduced froth formation and reduced foam stability.

DETAILED DESCRIPTION OF THE INVENTION

The present invention relates to the use of a composition comprising:

a) a compound of formula $R^1O\text{-}A\text{-}NH(CH_2)_nNH_2$ (I), wherein $R^1$ is a straight or branched hydrocarbyl group with 12-15 carbon atoms, A is a group —$CH_2CHXCH_2$—, wherein X is hydrogen or a hydroxyl group, preferably hydrogen, and n is a number 2-6, preferably 2-3, and most preferably 3;

b) a compound of formula $R^2NH_2$ (II), wherein $R^2$ is a hydrocarbyl group having 12-14 carbon atoms;

c) a compound of formula $R^3NH_2$ (III), wherein $R^3$ is a straight or branched, saturated or unsaturated hydrocarbyl group having 16-22, preferably 16-18 carbon atoms, and most preferably the group $R^3$ is oleyl; and d) optionally a depressing agent for the iron mineral, wherein the amount of a) is at least 65, preferably at least 70% by weight, based on the total weight of a), b) and c), and at most 90, preferably at most 85 and most preferably at most 80% by weight, based on the total weight of a), b) and c), and wherein the weight ratio between c) and b) is 4:1 to 1:1, preferably 3:1 to 1:1; as a collecting composition in a process for enriching an iron mineral from a silicate-containing iron ore by reverse froth flotation of the ore.

Further the invention relates to a process for enriching an iron mineral from a silicate-containing iron ore by reverse froth flotation of the ore using the above-mentioned collecting composition, and the collecting composition per se.

Suitable examples of groups $R^1$ are dodecyl, 2-butyloctyl, methyl-branched $C_{13}$-alkyl (isotridecyl), tetradecyl, and methyl-branched $C_{15}$-alkyl. Compounds having a branched alkyl group are especially preferred. Examples of suitable alkyl ether diamines to be used in the collecting compositions as component a) are N-[3-(dodecoxy)propyl]-1,3-propane diamine, N-[3-(2-butyloctoxy)propyl]-1,3-propane diamine, N[3-(tridecoxy)propyl]-1,3-propane diamine, N-[3-(tetradecoxy)propyl]-1,3-propane diamine, and N-[3-($C_{15}$-alkoxy) propyl]-1,3-propane diamine.

Suitable examples of groups $R^2$ are n-dodecyl, n-tetradecyl and mixtures thereof. A suitable example of a product comprising compounds having formula (II) is (coco alkyl)amine, since the major components present in this product are n-dodecylamine and n-tetradecylamine.

Suitable examples of groups $R^3$ are n-hexadecyl, n-octadecyl, octadecenyl, $C_{16}$-$C_{17}$-alkyl, oleyl, linoleyl, linolenyl, erucyl, and behenyl, and suitable products comprising compounds having formula (III) are (tallow alkyl)amine, (rapeseed alkyl)amine, and (soya alkyl)amine. Among the compounds derived from natural sources those having unsaturated alkyl chains are especially preferred, because they are easier to formulate.

Most preferred are the embodiments where component b) is added as a (coco alkyl)amine and component c) is oleylamine Unprotonated amines with the formulae described above (formulae I-III) are difficult to disperse in mineral/water systems without the aid of heating or vigorous stirring. Even with heating and stirring, the dispersions are not stable. A common practice for improving the dispersibility of amines is to prepare the corresponding ammonium salts by adding acid to the amine, forming at least 20% by mole ammonium salt, preferably before the amine compounds are diluted with water. Examples of suitable acids are lower organic acids, such as formic acid, acetic acid, and propionic acid; and inorganic acids, such as hydrochloric acid. Complete formation of ammonium salt is not needed to form a stable dispersion. In an aqueous mixture the amine compounds are therefore suitably present partly as ammonium salts. For example, 20-70, preferably 25-50% of the amine groups are transferred to ammonium groups, which may be achieved by adding about 10% by weight acetic acid to the amine compounds of the invention.

Preferably, the flotation is performed in the conventional pH-range of 7-11 in order to obtain the right surface charge of the minerals.

A conventional depressing agent, such as a polysaccharide, preferably a hydrophilic polysaccharide, e.g. different kinds of starches or dextrin, may be used in a conventional quantity sufficient to cover the iron ore surface in the amount needed. The depressing agent is normally added in an amount of 10 to 1,000 g per metric ton of ore.

Further conventional additives may be added to the flotation system, such as pH-regulating agents and co-collectors.

The principal ores of iron which are suitable for treatment according to the invention are magnetite and hematite ores.

The collecting composition is especially beneficent to use for ores having a $K_{80}$ less or equal to 70 μm, suitably less or equal to 50 μm, for example less or equal to 35 μm.

The present invention is further illustrated by the following examples.

EXAMPLES

General Experimental

Iron ore containing 62.9% Fe and 10.3% $SiO_2$ (XRF analysis) or 12.2% as acid insoluble was used to in this Example to illustrate the invention. The sieve analysis for this ore is displayed in Table 1.

TABLE 1

| Sieve analysis $K_{80}$ = 30.3 μm | |
|---|---|
| Sieve aperture (μm) | Accumulated weight quantity of ore passing through sieve aperture (%) |
| 90 | 99.5 |
| 63 | 97.0 |

TABLE 1-continued

| Sieve analysis $K_{80}$ = 30.3 μm | |
|---|---|
| Sieve aperture (μm) | Accumulated weight quantity of ore passing through sieve aperture (%) |
| 50 | 95.1 |
| 40 | 91.2 |
| 32 | 80.4 |
| 20 | 61.0 |

Collector Preparation

N-(3-Isotridecoxypropyl)-1,3-propane diamine (representing compound a), coco alkyl amine (representing compound b), and oleyl amine (representing compound c) was formulated into collecting compositions and neutralized by 10% by weight of acetic acid. 1 g of neutralized collecting composition was diluted with 99 g of de-ionised water to a working solution. The working solution was stirred for at least 15 min before use.

Flotation Procedure

Flotation tests were performed with a Denver laboratory flotation machine. The machine is modified and equipped with an automatic froth scraping device and a double lip cell.

The ground ore sample (683 g) was conditioned with collector for 2 min at a concentration of solid of 37% by weight (=37% pulp density). All water added during the flotation was synthetic process water (see Table 2). The speed of the rotor was 900 rpm. The collectors were added as the 1% by weight working solutions described above. The actual dosages, in mg collector composition/metric ton ore are described in each of the examples. The pulp with the added components was conditioned for 1 min before the air and the automatic froth scrapers were turned on. The flotation was performed at 20-25° C. using an air flow of 2.5 l/min and a scraping frequency of 15 scrapes/min. The pulp level was kept constant by the addition of water below the pulp surface. The flotation was continued until complete exhaustion of mineralized froth was achieved.

TABLE 2

Synthetic process water used in flotation tests and froth measurements.

| pH | Ca mg/l | Mg mg/l | Na mg/l | $SO_4$ mg/l | Cl mg/l | $HCO_3$ mg/l |
|---|---|---|---|---|---|---|
| approx.8 | 65 | 135 | 685 | 750 | 910 | 250 |

The flotation was performed in a sequence with two additions of collector followed by a flotation step after each addition, so called step-wise rougher flotation. Each froth product was dried, weighed, and analyzed with respect to silica ($SiO_2$) content. After completion of the flotation, the bottom concentrate was withdrawn, dried, and analyzed with respect to $SiO_2$ content and $Fe_2O_3$ content. The $SiO_2$ content was analysed as acid insoluble by a gravimetric chemical method. After dissolution of sample in boiling hydrochloric acid the acid insoluble residue was measured. For each completed flotation experiment the mass balance and $SiO_2$ grades were used to calculate the iron recovery and $SiO_2$ grade in each flotation step, and these results were then plotted in a grade-recovery graph. From this graph the iron recovery was determined by interpolation at a given $SiO_2$ grade for this specific flotation experiment. The selectivity index is one measure of the selectivity of the flotation. Here the relationship between $SiO_2$-recovery and Fe-recovery is used. Note that $SiO_2$-recovery means how much of original silica, as acid insoluble, that remains in the Fe-concentrate (cell product) after flotation. This value should be low, but the Fe recovery on the other hand should be high. This means that a good selectivity index should be as low as possible. Selective index is calculated as:

$$\text{Selectivity Index}=SiO_2\ \text{Recovery}(\%)/\text{Fe Recovery}(\%)$$

Froth Properties Measurement

The froth characteristics have been measured by using a device called a froth column, a cylindrical tube with a diameter of 14 cm. It is equipped with a stirring device (rotor and stator) at the bottom and controlled air supply in the agitating zone.

Ore sample (flotation feed, 1370 g) is conditioned with collector at a concentration of 37% by weight solids (37% pulp density) in synthetic process water. Rotor speed is 1000 rpm. The ore slurry is first conditioned for 2 minutes, then after addition of collector additionally 2 minutes conditioning before air is turned on (2.5 l/second). Collector solution is prepared in the same way as for flotation tests.

The dynamic froth expansion during aeration, equilibrium height and then bursting after stopped aeration is measured every 20 second. The results are plotted as time (s) versus froth height. From these plots data is extracted to compare froth characteristics as equilibrium height during aeration (froth formation=froth bursting), called Maximum height. The froth bursting is measured after 3 minutes without aeration and is called Froth decay. This method is described in literature by Zanin M and Grano S. R, *Selecting Frothers for the flotation of Specific Ores by Means of Batch Scale Foaming Tests, Proceeding MetPlant* 2006, 18-19 Sep. 2006 Perth, Wash.; Cilliers, Griffith, Measuring Froth Stability, WO 2004/080600

The results from the flotation procedure and the froth properties measurements for a series of collecting compositions are listed in Table 3 below.

TABLE 3

Results from flotation procedure and the froth properties measurements

| | | Metallurgical results Fe-concentrate | | | | | Froth characteristic | |
|---|---|---|---|---|---|---|---|---|
| Exp. No. | Collector composition | Grade $SiO_2$[1)] % | Fe-Recovery % | $SiO_2$[1)] Recovery % | Selectivity index | Dosage (g/ton) | Maximum height (cm) | Froth Decay Height (cm) |
| A | N-(3-Isotridecoxypropyl)-1,3-propane diamine/oleyl amine (60/40) (Comparison) | 6.0 | 75.1 | 34.8 | 0.46 | 117 | — | — |
| B | N-(3-Isotridecoxypropyl)-1,3-propane diamine/Coco alkyl amine (60/40) (Comparison) | 4.3 | 59.2 | 21.5 | 0.36 | 90 | 41 | 27 |
| C | N-(3-Isotridecoxypropyl)-1,3-propane diamine/oleyl amine (80/20) (Comparison) | 4.9 | 67.5 | 28.0 | 0.42 | 117 | — | — |

TABLE 3-continued

Results from flotation procedure and the froth properties measurements

| Exp. No. | Collector composition | Metallurgical results Fe-concentrate: Grade $SiO_2$[1)] % | Fe-Recovery % | $SiO_2$[1)] Recovery % | Selectivity index | Dosage (g/ton) | Froth characteristic: Maximum height (cm) | Froth Decay Height (cm) |
|---|---|---|---|---|---|---|---|---|
| D | N-(3-Isotridecoxypropyl)-1,3-propane diamine/Coco alkyl amine (80/20) (Comparison) | 3.9 | 55.9 | 17.8 | 0.32 | 110 | 51 | 27 |
| E | N-(3-Isotridecoxypropyl)-1,3-propane diamine/oleyl amine/ Coco alkyl amine (60/25/15) (Comparison) | 4.3 | 58.9 | 19.1 | 0.33 | 117 | 41 | 27 |
| F | N-(3-Isotridecoxypropyl)-1,3-propane diamine/oleyl amine/ Coco alkyl amine (60/15/25) (Comparison) | 3.9 | 56.0 | 16.6 | 0.30 | 114 | 53 | 38 |
| G | N-(3-Isotridecoxypropyl)-1,3-propane diamine/oleyl amine/ Coco alkyl amine (80/5/15) (Comparison) | 3.9 | 56.2 | 17.7 | 0.32 | 114 | 43 | 25 |
| 1 | N-(3-Isotridecoxypropyl)-1,3-propane diamine/oleyl amine/ Coco alkyl amine (80/15/5) | 4.0 | 58.4 | 18.2 | 0.31 | 117 | 36 | 18 |
| 2 | N-(3-Isotridecoxypropyl)-1,3-propane diamine/oleyl amine/ Coco alkyl amine (80/10/10) | — | — | — | — | — | 40 | 18 |
| 3 | N-(3-Isotridecoxypropyl)-1,3-propane diamine/oleyl amine/ Coco alkyl amine (70/20/10) | 4.4 | 65.2 | 22.0 | 0.34 | 118 | 33 | 19 |
| 4 | N-(3-Isotridecoxypropyl)-1,3-propane diamine/oleyl amine/ Coco alkyl amine (75/15/10) | 4.1 | 60.9 | 19.4 | 0.32 | 116 | 38 | 18 |
| 5 | N-(3-Isotridecoxypropyl)-1,3-propane diamine/oleyl amine/ Coco alkyl amine (75/20/5) | 4.6 | 63.6 | 22.6 | 0.36 | 116 | 29 | 12 |

[1)]measured as acid insoluble

Formulations containing compounds a) and b); a) and c); and a), b) and c) are compared by both metallurgical results as Fe-Recovery (%), Silica Grade (%), Selectivity index, and dosage of collector (g/ton); and Froth data described as maximum froth height during aeration and froth height 3 minutes after stopped airflow. Experiments A-G are comparison tests and experiments 1-5 are tests performed according to the invention.

As mentioned above, the flotation feed contained 12.2% $SiO_2$ as acid insoluble. The target is a reduction of silica down to a $SiO_2$ grade of 4.0-4.5% as acid insoluble. The flotation tests are done in two steps with addition of collector composition in each. Due to problems to forecast appropriate dosages some examples are missing the target to some extent. The flotation tests give grade-recovery graphs which are used to determine dosage level and Fe/Si-Recoveries for each test to be compared. In the froth studies the same dosages are used as required for the desired metallurgical result.

By using a collector composition consisting of component a) and b) good metallurgical results are obtained (Exp No B and D). However, Froth characteristics, described by Maximum height and Froth decay Height (after 3 minutes) show a Maximum height of 40 to 50 cm and a Froth decay height of 27 cm in both tests. This indicates a more stable froth. Especially the Froth decay height is of importance as it predicts the stability of froth.

When a collector composition consisting of component a) and c) is used the metallurgical results are not good enough. The high silica levels indicate poor efficiency and further these comparison examples show the highest Selectivity Indexes (>0.42). Because of the poor metallurgical results no froth properties measurements were performed for these compositions (Exp. No. A and C).

When components a), b) and c) are used as a three component collector composition outside the range of the concentration ratios as defined for the present invention the metallurgical results are good, but froth characteristics are about the same as when a collector composition consisting of only a) and b) is used or even worse (Exp No E, F, G). The Maximum height of froth for these tests varied between 41 to 53 cm and the Froth decay height was 25 to 38 cm.

By using the ratios between a), b) and c) in Exp Nos. 1 to 5, which all are inside the ranges defined by the invention, the metallurgical results were good or acceptable and at the same time, a significant reduction in froth stability was observed. For these tests, the Maximum froth height was 29 to 40 cm and the Froth Decay height was 12 to 19 cm. The Maximum froth height was reduced with about 25% and the Froth decay height with about 30 to 60% as compared to the comparison tests (Exp No E, F, G)

These results surprisingly show that it is possible to reduce the stability of flotation froth by using components a)+b)+c) in the ratios defined by this invention.

The invention claimed is:

1. A process for enriching an iron mineral from a silicate-containing iron ore by reverse froth flotation of the ore using a collecting composition comprising the step of contacting the ore with the collecting composition, wherein the collecting composition comprises:

a) a compound of formula $R^1O\text{-}A\text{-}NH(CH_2)_nNH_2$ (I), wherein $R^1$ is a straight or branched hydrocarbyl group with 12-15 carbon atoms, A is a group —$CH_2CHXCH_2$—, wherein X is hydrogen or a hydroxyl group, and n is a number 2-6;

b) a compound of formula $R^2NH_2$ (II), wherein $R^2$ is a hydrocarbyl group having 12-14 carbon atoms;

c) a compound of formula $R^3NH_2$ (III), wherein $R^3$ is a straight or branched, saturated or unsaturated hydrocarbyl group having 16-22 carbon atoms; and d) optionally a depressing agent for the iron mineral, wherein the amount of a) is at least 65% by weight, based on the total weight of a), b) and c), and at most 90% by weight, based on the total weight of a), b) and c), and wherein the weight ratio between c) and b) is 4:1 to 1:1.

2. A process according to claim 1 wherein the weight ratio between c) and b) is 3:1 to 1:1.

3. A process according to claim 1 comprising a further component d) which is a depressing agent for the iron mineral.

4. A process according to claim 3 wherein the depressing agent is chosen from the group of polysaccharides.

5. A process according to claim 4 wherein component d) is starch.

6. A process according to claim 4 wherein component d) is dextrin.

7. A process according to claim 1 wherein c) is a compound (III) wherein $R^3$ is a hydrocarbyl group having 16-18 carbon atoms.

8. A process according to claim 1 wherein component b) is added as (coco alkyl)amine.

9. A process according to claim 1 wherein the amine components in the collecting composition are present as ammonium salts in an amount of at least 20% by mole.

10. A process according to claim 1 where the collecting composition comprises a) N-(3-isotridecoxypropyl)-1,3-propane diamine, b) a (coco alkyl)monoamine comprising compounds of formula II, wherein $R^2$ is a hydrocarbyl group with 12-14 carbon atoms, and c) oleylamine.

11. A process according to claim 1 where the amount of a) is at least 70 and at most 80% by weight, based on the total weight of a), b) and c).

12. A collecting composition comprising a) a compound having the formula $R^1O\text{-}A\text{-}NH(CH_2)_nNH_2$ (I), wherein $R^1$ is a straight or branched hydrocarbyl group with 12-15 carbon atoms, A is a group $—CH_2CHXCH_2—$, wherein X is hydrogen or a hydroxyl group, and n is a number 2-6;

b) a compound having the formula $R^2NH_2$ (II), wherein $R^2$ is a hydrocarbyl group having 12-14 carbon atoms;

c) a compound having the formula $R^3NH_2$ (III), wherein $R^3$ is a straight or branched, saturated or unsaturated hydrocarbyl group having 16-22 carbon atoms; and d) optionally a depressing agent for the iron mineral, wherein the amount of a) is at least 65% by weight, based on the total weight of a), b) and c), and at most 90% by weight, based on the total weight of a), b) and c), and wherein the weight ratio between c) and b) is 4:1 to 1:1.

13. A collecting composition according to claim 12 wherein the weight ratio between c) and b) is 3:1 to 1:1.

14. A collecting composition according to claim 12 comprising a further component d) which is a depressing agent for the iron mineral.

15. A collecting composition according to claim 14 wherein the depressing agent is chosen from the group of polysaccharides.

16. A collecting composition according to claim 15 wherein component d) is starch.

17. A collecting composition according to claim 15 wherein component d) is dextrin.

18. A collecting composition according to claim 12 wherein c) is a compound (III) wherein $R^3$ is a hydrocarbyl group having 16-18 carbon atoms.

19. A collecting composition according to claim 12 wherein component b) is added as (coco alkyl)amine.

20. A collecting composition according to claim 12 wherein the amine components in the collecting composition are present as ammonium salts in an amount of at least 20% by mole.

21. A collecting composition according to claim 12 where the collecting composition comprises a) N-(3-isotridecoxypropyl)-1,3-propane diamine, b) a (coco alkyl)monoamine comprising compounds of formula II, wherein $R^2$ is a hydrocarbyl group with 12-14 carbon atoms, and c) oleylamine.

22. A collecting composition according to claim 12 where the amount of a) is at least 70 and at most 80% by weight, based on the total weight of a), b) and c).

* * * * *